US007093728B2

(12) United States Patent
Chen

(10) Patent No.: US 7,093,728 B2
(45) Date of Patent: Aug. 22, 2006

(54) SUPPORT STAND FOR SHELF

(76) Inventor: Po-Ju Chen, 58, Ma Yuan West St., Taichung (TW)

( * ) Notice: Subject to any disclaimer, the term of this patent is extended or adjusted under 35 U.S.C. 154(b) by 213 days.

(21) Appl. No.: 10/751,559

(22) Filed: Dec. 31, 2003

(65) Prior Publication Data

US 2005/0139562 A1 Jun. 30, 2005

(51) Int. Cl.
*A47F 5/14* (2006.01)

(52) U.S. Cl. ..... 211/187; 211/153; 211/181.1

(58) Field of Classification Search ..... 211/181.1, 211/126.9, 49.1, 71.01, 85.25, 187, 85.31, 211/153, 119.003, 123, 126.1, 126.4, 134, 211/126.8, 42, 126.11, 43, 126.12, 133.1–133.2, 211/190; 108/152, 64, 65, 157.13, 59, 144.11, 108/147.11, 147.12, 147.13, 147.14, 147.15; 248/235, 127, 163.1, 151, 153, 155.2, 126, 248/121, 250; 198/860.1
See application file for complete search history.

(56) References Cited

U.S. PATENT DOCUMENTS

| | | | | |
|---|---|---|---|---|
| 2,933,193 | A * | 4/1960 | De Mattia | 108/156 |
| 5,924,581 | A * | 7/1999 | Chen | 211/187 |
| 6,044,988 | A * | 4/2000 | Yang | 211/187 |
| 6,068,143 | A * | 5/2000 | Wang | 211/187 |
| 6,257,426 | B1 * | 7/2001 | Masunaka et al. | 211/187 |
| 6,364,138 | B1 * | 4/2002 | Chen | 211/187 |

* cited by examiner

*Primary Examiner*—Richard E. Chilcot, Jr.
*Assistant Examiner*—Lindsay M. Maguire
(74) *Attorney, Agent, or Firm*—Alan D. Kamrath; Nikolai & Mersereau, P.A.

(57) ABSTRACT

A shelf includes a plurality of support stands each having a periphery formed with a plurality of elongated flanges. Each of the flanges has two opposite sides each formed with a reduced neck. Thus, the flanges of each of the support stands are combined with the racks in various different angles, so that the angle and mode of assembly of the shelf can be changed arbitrarily so as to fit the requirement of different sites, such as the house, the exhibition place or the like, thereby enhancing the versatility of the shelf.

12 Claims, 9 Drawing Sheets

SUPPORT STAND FOR SHELF

BACKGROUND OF THE INVENTION

1. Field of the Invention

The present invention relates to a support stand for a shelf, and more particularly to a shelf that can be expanded easily and arbitrarily.

2. Description of the Related Art

A first conventional shelf in accordance with the prior art shown in FIG. 7 comprises four support legs 40 each formed with a plurality of grooves 41, four foldable mounting rings 42 each mounted on a respective one of the support legs 40, and a rack 44 mounted between the support legs 40 and provided with four mounting sleeves 46 each mounted on a respective one of the mounting rings 42. However, the first conventional shelf has a fixed structure and cannot be expanded, thereby limiting the versatility of the first conventional shelf.

A second conventional shelf in accordance with the prior art shown in FIG. 8 comprises four support legs 50 each formed with two lugs 51 each formed with a plurality of grooves 53 and a reduced portion 52 located between the two lugs 51, four opened clamping plates 54 each mounted on either one of the two lugs 51 of a respective one of the support legs 50 and each formed with two locking blocks 55 each inserted into one of the grooves 53 of the respective lug 51, and a rack 56 mounted between the support legs 50 and provided with four opened mounting plates 57 each mounted on a respective one of the clamping plates 54. Thus, either one of the two lugs 51 of each of the support legs 50 is combined with the clamping plate 54 and the mounting plate 57 of the rack 56, so that the support legs 50 can be used to connect two racks 56, thereby expanding the second conventional shelf. However, the second conventional shelf cannot be expanded arbitrarily, thereby easily limiting the versatility of the second conventional shelf.

SUMMARY OF THE INVENTION

The primary objective of the present invention is to provide a shelf that can be expanded easily and arbitrarily.

Another objective of the present invention is to provide a shelf, wherein the flanges of each of the support stands are combined with the racks in various different angles, so that the angle and mode of assembly of the shelf can be changed arbitrarily so as to fit the requirement of different sites, such as the house, the exhibition place or the like, thereby enhancing the versatility of the shelf A further objective of the present invention is to provide a shelf, wherein the insertion strip of each of the fixing plates is inserted into either one of the grooves of the respective flange of each of the support stands, so that the height of the rack can be changed arbitrarily so as to fit the user's requirement.

In accordance with the present invention, there is provided a support stand, comprising:

a plurality of support stands each having a periphery formed with a plurality of elongated flanges and a plurality of arcuate connecting faces located between the flanges;

each of the flanges having two opposite sides each formed with a neck connected to a respective one of the arcuate connecting faces; and each of the flanges having a surface formed with a plurality of grooves.

Further benefits and advantages of the present invention will become apparent after a careful reading of the detailed description with appropriate reference to the accompanying drawings.

DETAILED DESCRIPTION OF THE INVENTION

Figure 1:
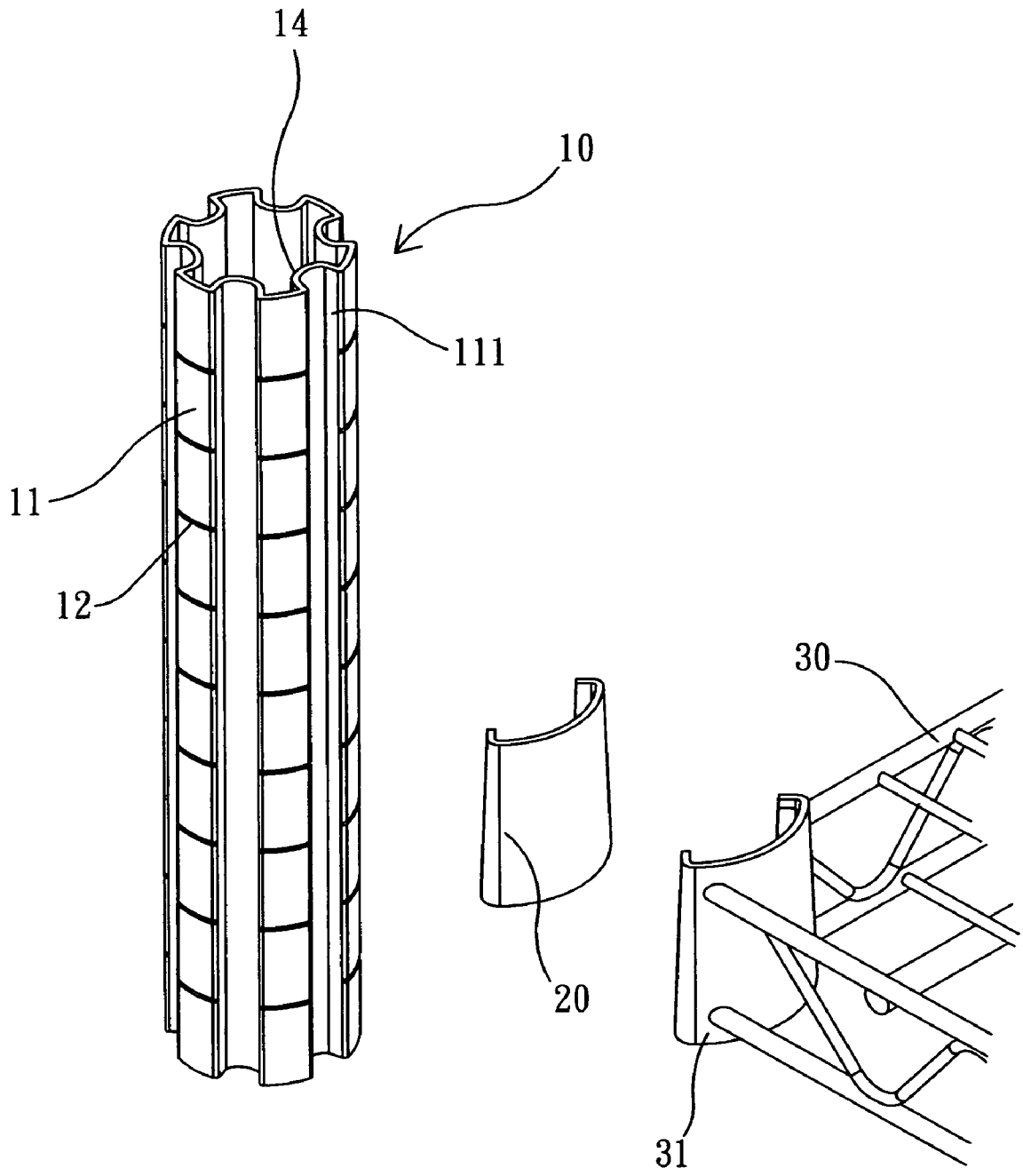
FIG. 1 is a partially cut-away exploded perspective view of a shelf in accordance with the preferred embodiment of the present invention.
Figure 2:
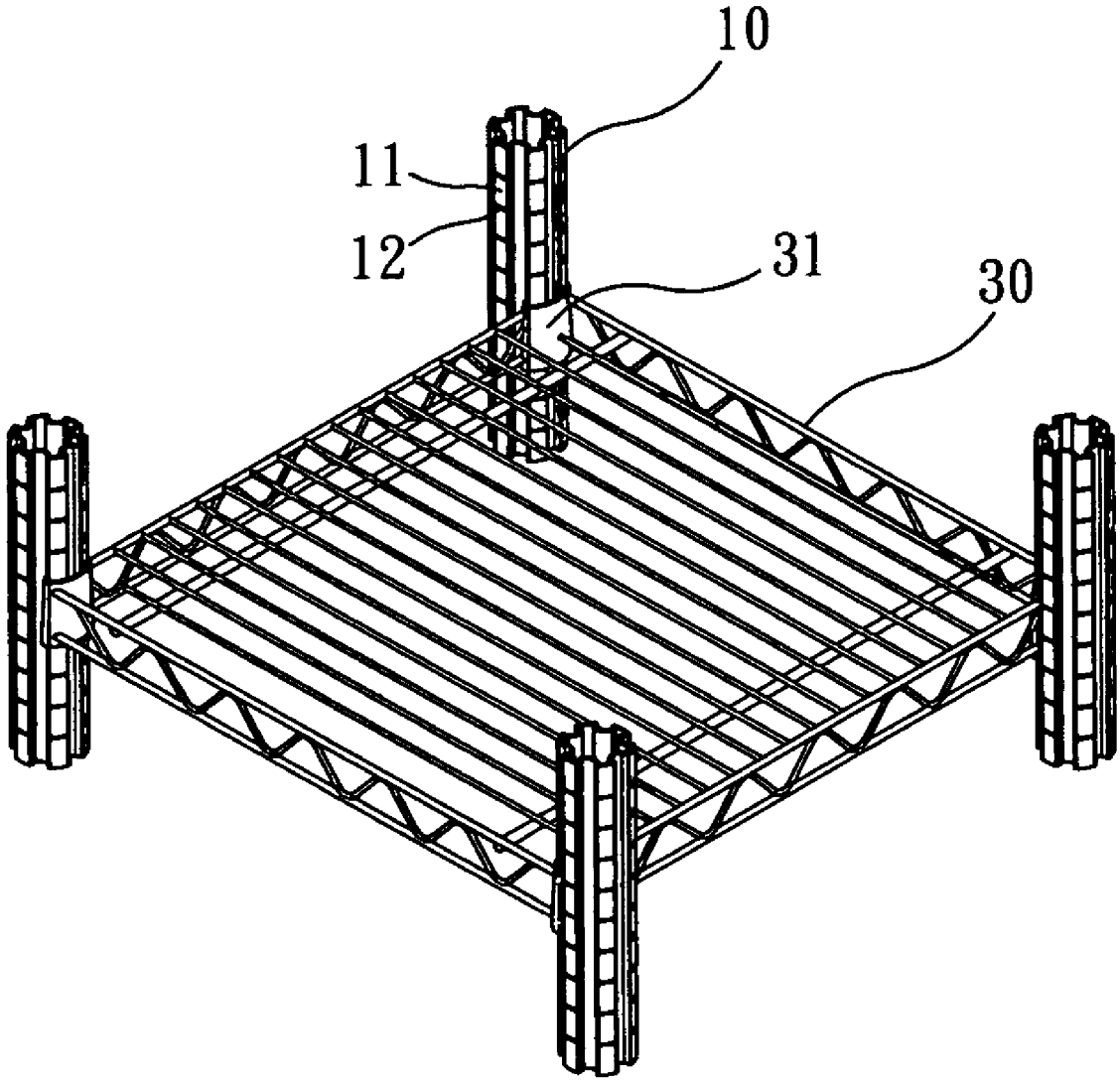
FIG. 2 is a perspective view of the shelf in accordance with the preferred embodiment of the present invention.

Referring to the drawings and initially to. FIGS. 1 and 2, a shelf in accordance with the preferred embodiment of the present invention comprises a rack 30 provided with a plurality of arcuate mounting plates 31, a plurality of arcuate fixing plates 20 each mounted on a respective one of the mounting plates 31 of the rack 30, and a plurality of support stands 10 each mounted on a respective one of the fixing plates 20 for supporting the rack 30.

Each of the mounting plates 31 of the rack 30 has a tapered shape.

Each of the support stands 10 has a tubular shape and has a periphery formed with six elongated flanges 11 and six arcuate connecting faces 14 located between the six flanges 11. The flanges 11 are arranged in an annular shape and are equally distant from each other. Each of the flanges 11 is directed toward a center of each of the support stands 10. Each of the flanges 11 is substantially dovetail-shaped and has a width gradually reduced from the periphery to the center of each of the support stands 10. Each of the flanges 11 has two opposite sides each formed with a neck 111 connected to a respective one of the arcuate connecting faces 14. Each of the flanges 11 has a surface formed with a plurality of grooves 12. The grooves 12 of the flanges 11 are arranged in a circular shape.

Figure 1A:
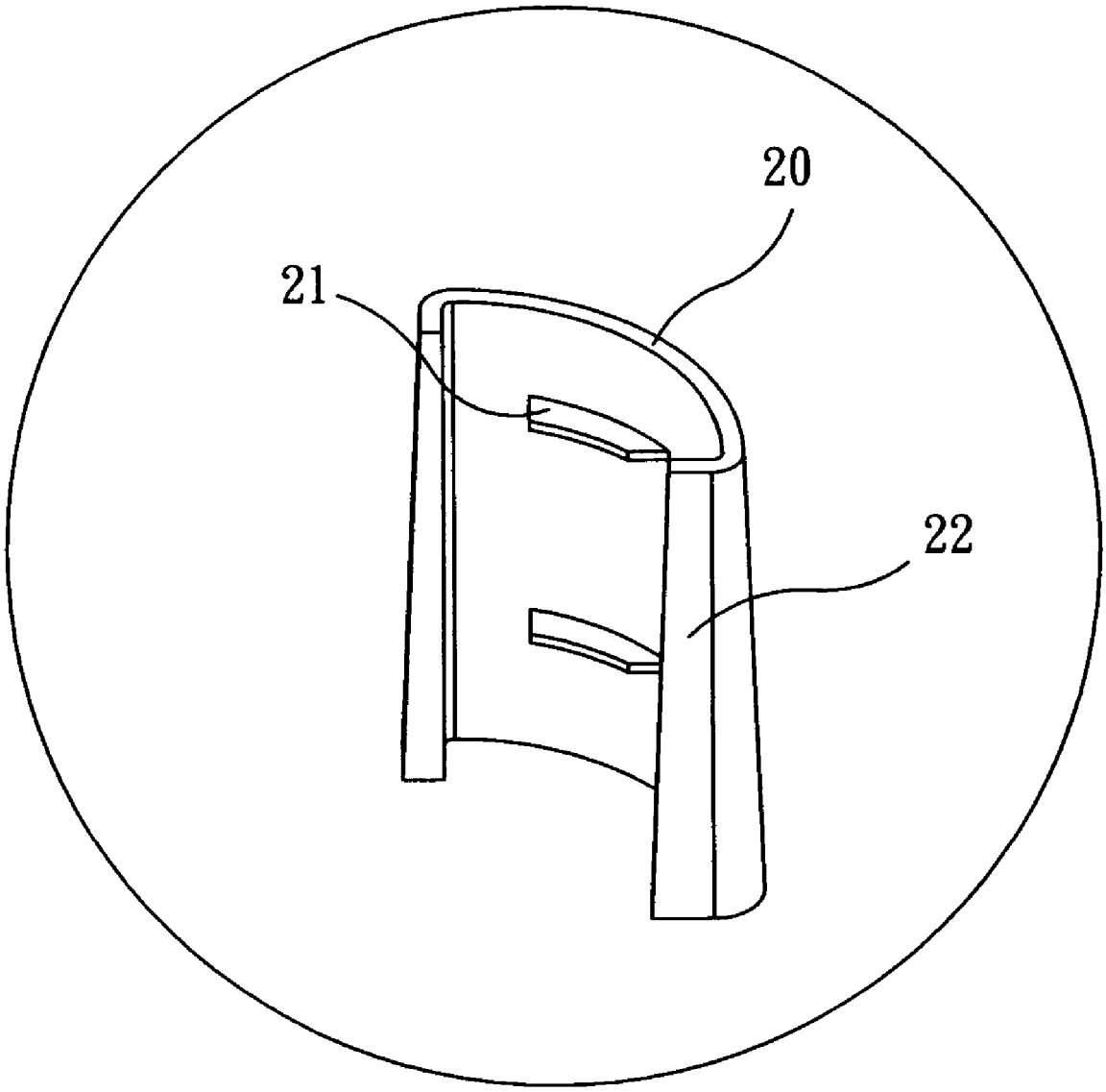
FIG. 1A is a perspective view of a fixing plate of the shelf as shown in FIG. 1.

Each of the fixing plates 20 has a tapered shape and has a first side mounted on a respective one of the mounting plates 31 of the rack 30 and a second side mounted on either one of the flanges 11 of the respective support stands 10. The second side of each of the fixing plates 20 is formed with a plurality of insertion strips 21 (see FIG. 1A) each inserted into a respective one of the grooves 12 of the respective flange 11. Each of the fixing plates 20 has two ends each formed with a hook 22 urged on the neck 111 of the respective flange 11.

In assembly, each of the fixing plates 20 is mounted on either one of the flanges 11 of the respective support stands 10, with each of the insertion strips 21 being inserted into a respective one of the grooves 12 of the respective flange 11. Then, each of the mounting plates 31 of the rack 30 is mounted on the respective fixing plate 20 in a close tapered fit manner, thereby forming the shelf as shown in FIG. 2.

As shown in FIG. 2, a rack 30 is combined with four support stands 10 to form the shelf.

Figure 3:
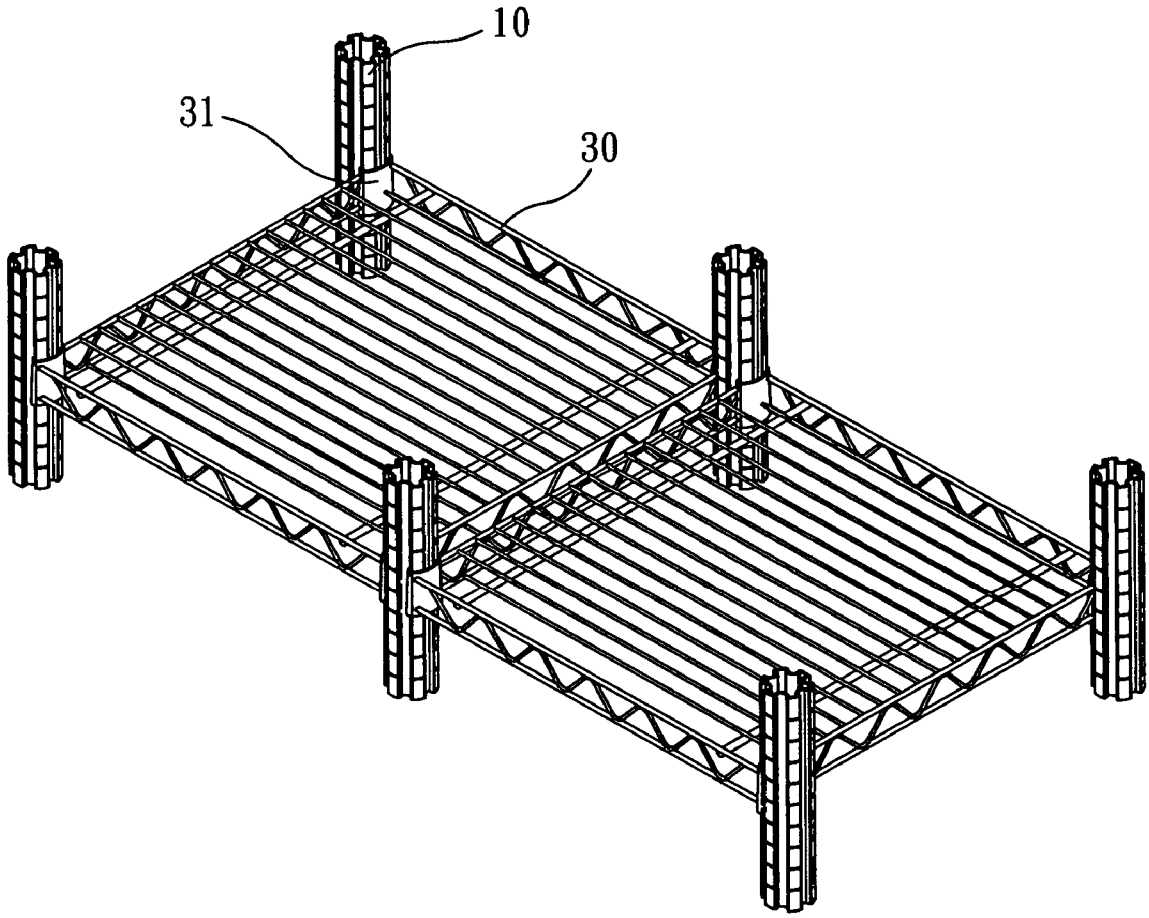
FIG. 3 is a perspective view of the shelf in accordance with another embodiment of the present invention.

As shown in FIG. 3, two racks 30 are combined with six support stands 10 to form the shelf which is expanded horizontally.

Figure 4:
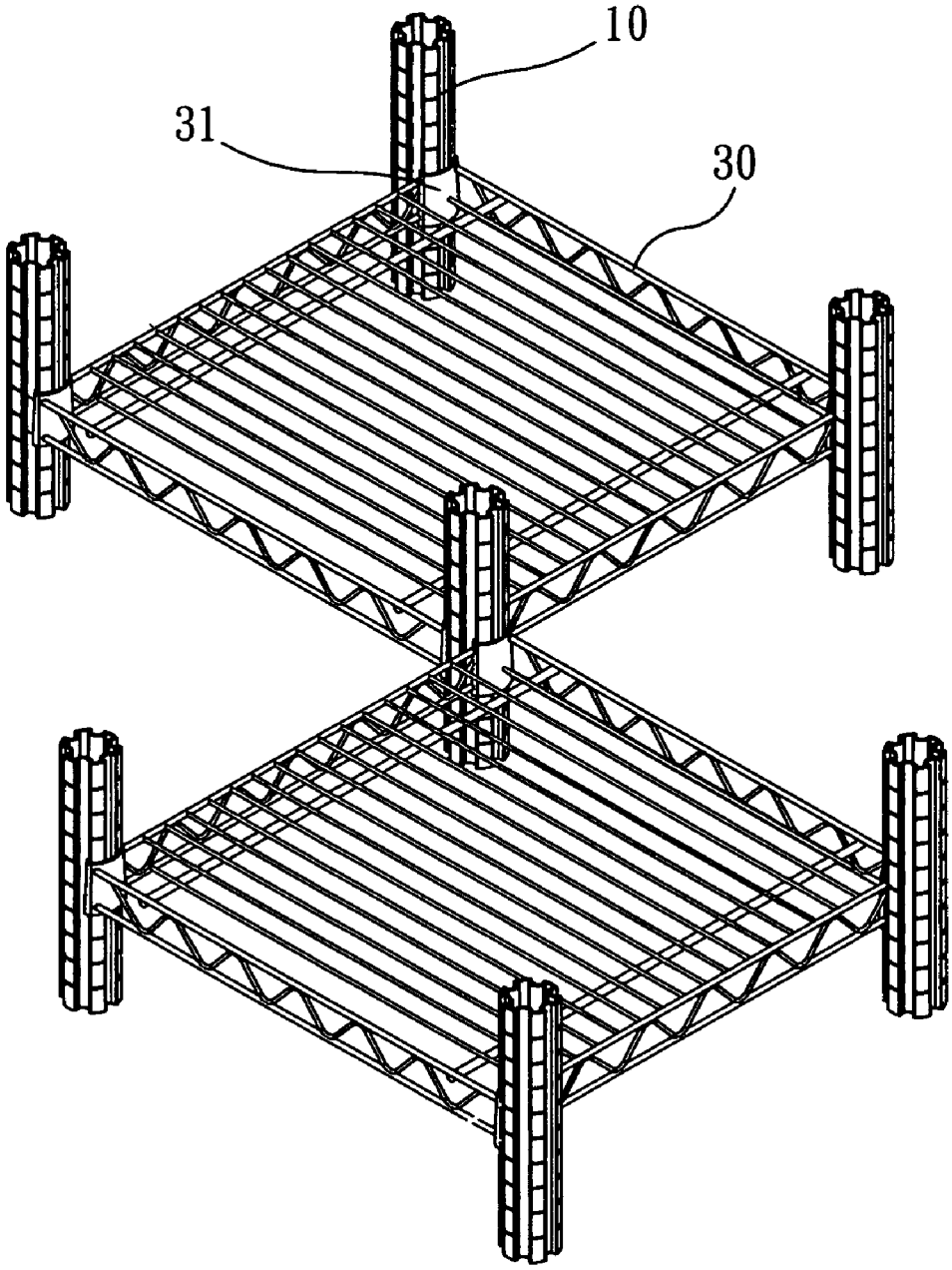
FIG. 4 is a perspective view of the shelf in accordance with another embodiment of the present invention.

As shown in FIG. 4, two racks 30 are combined with seven support stands 10 to form the shelf which is expanded diagonally.

Figure 5:
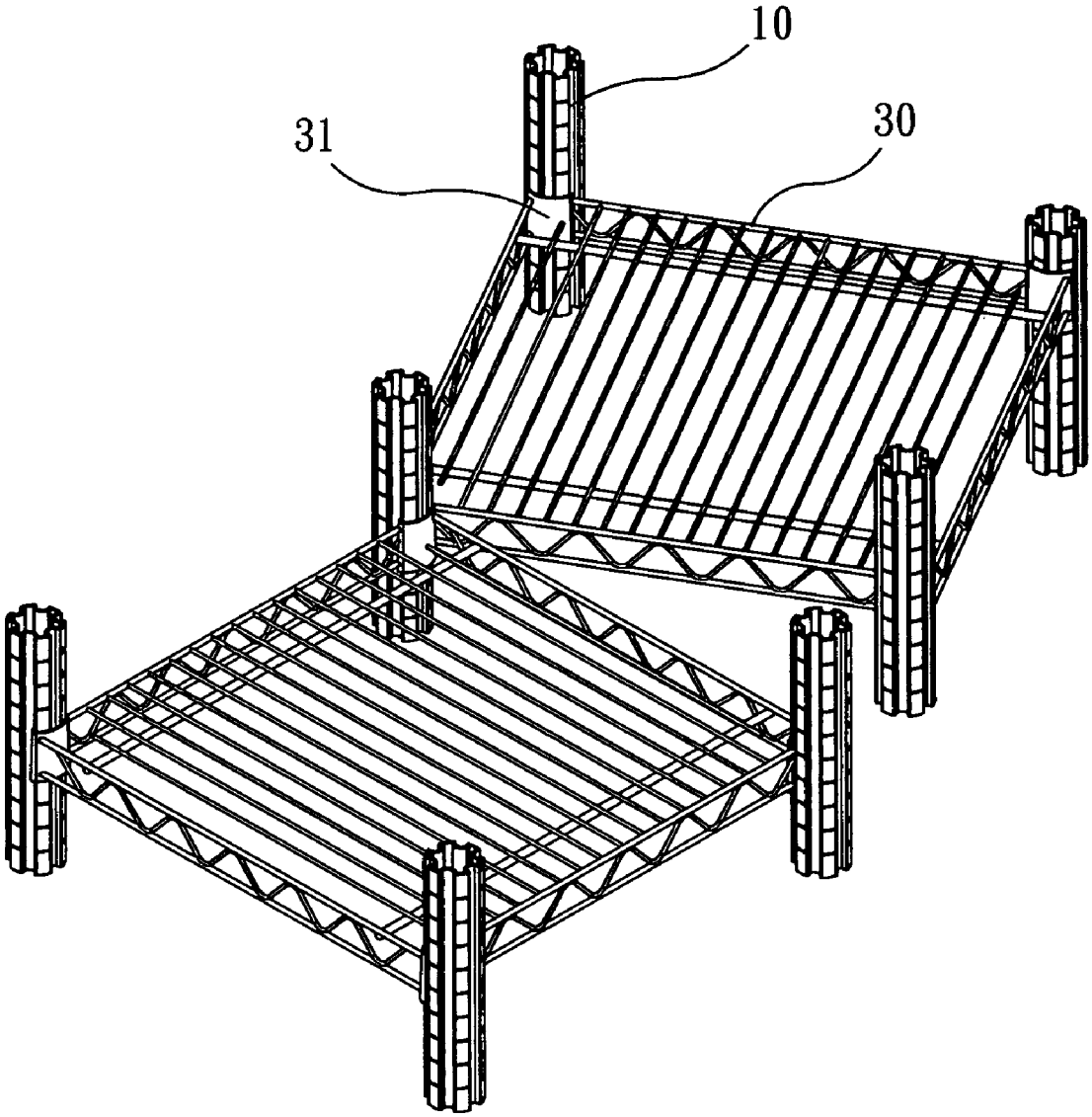
FIG. 5 is a perspective view of the shelf in accordance with another embodiment of the present invention.

As shown in FIG. 5, two racks 30 are combined with seven support stands 10 to form the shelf which is expanded triangularly.

Figure 6:
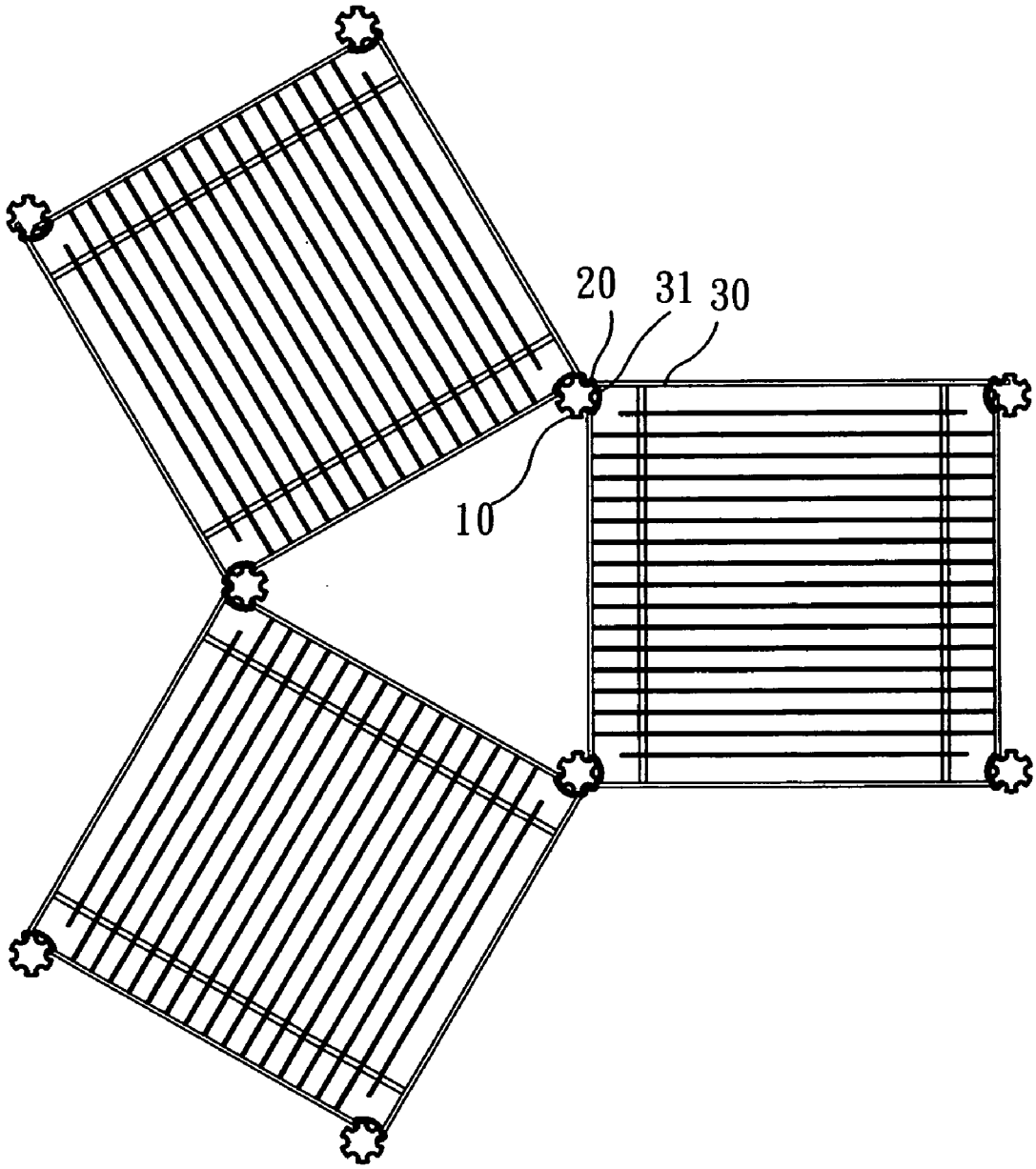
FIG. 6 is a perspective view of the shelf in accordance with another embodiment of the present invention.
Figure 7:
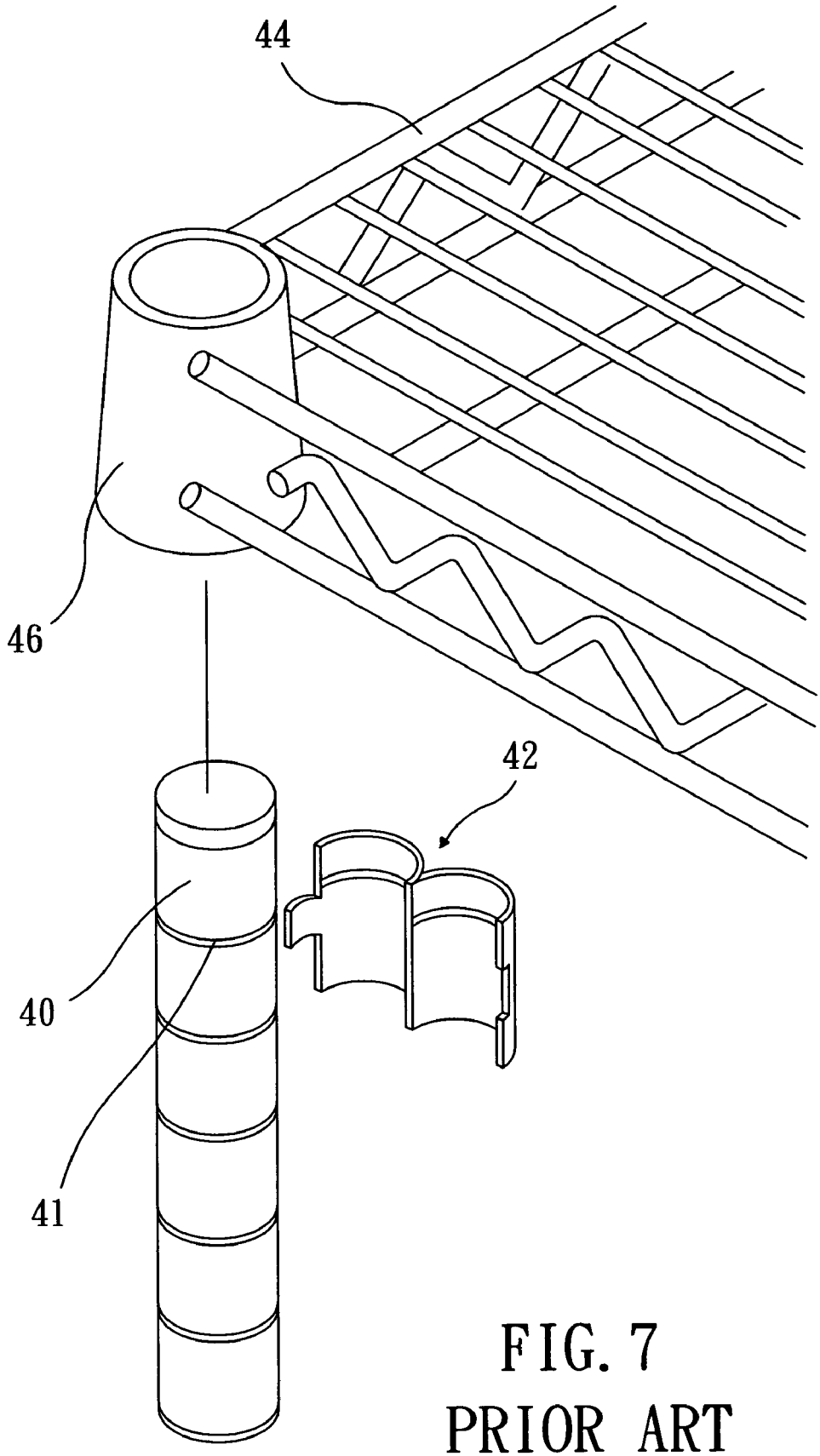
FIG. 7 PRIOR ART
FIG. 7 is a partially cut-away exploded perspective view of a first conventional shelf in accordance with the prior art.
Figure 8:
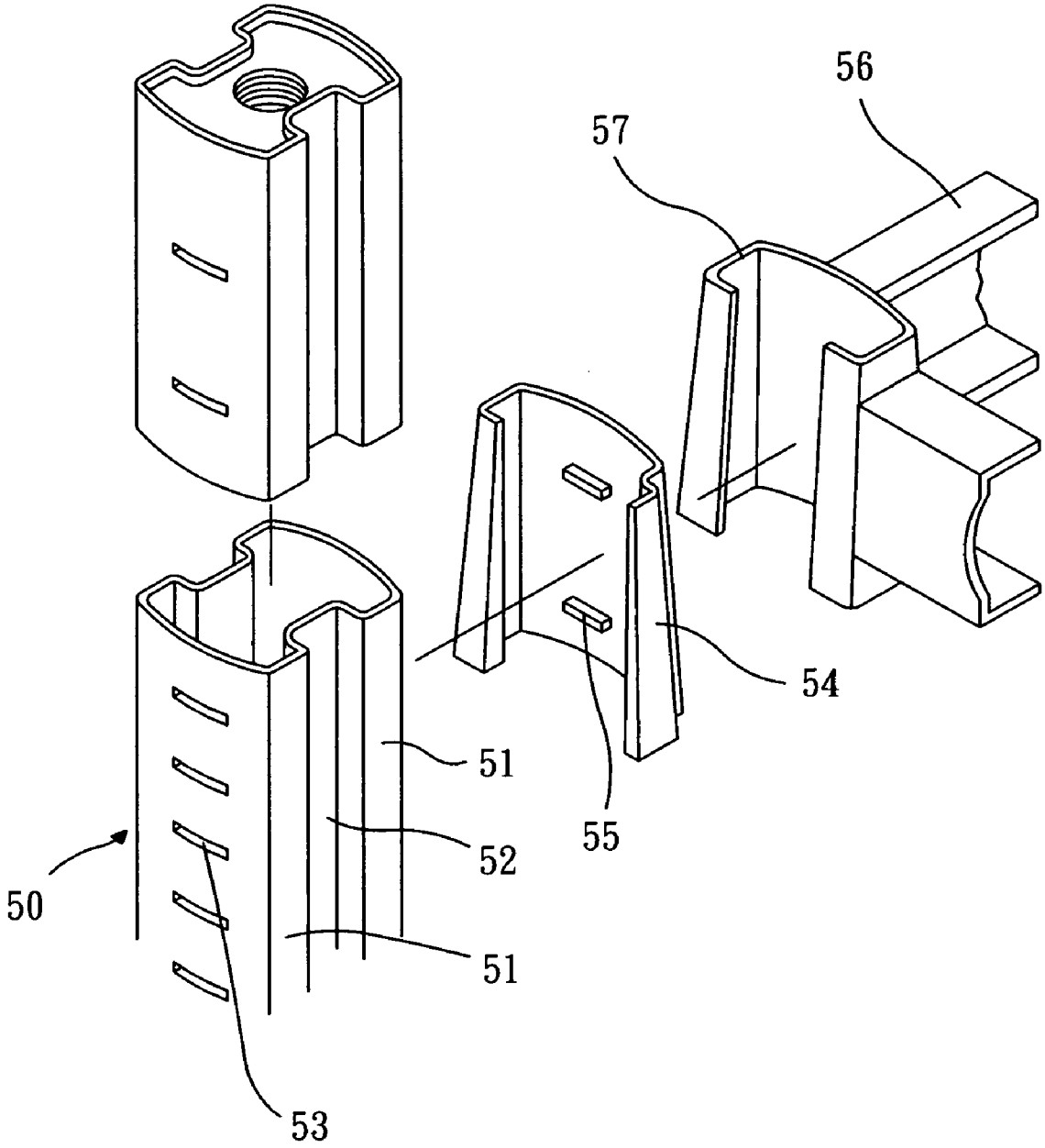
FIG. 8 PRIOR ART
FIG. 8 is a partially cut-away exploded perspective view of a second conventional shelf in accordance with the prior art.

As shown in FIG. 6, three racks 30 are combined with nine support stands 10 to form the shelf which is expanded to form a loop.

Accordingly, the flanges 11 of each of the support stands 10 are combined with the racks 30 in various different angles as shown in FIGS. 2–6, so that the angle and mode of assembly of the shelf can be changed arbitrarily so as to fit the requirement of different sites, such as the house, the exhibition place or the like, thereby enhancing the versatility of the shelf. In addition, the insertion strip 21 of each of the fixing plates 20 is inserted into either one of the grooves 12 of the respective flange 11 of each of the support stands 10, so that the height of the rack 30 can be changed arbitrarily so as to fit the user's requirement.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A shelf, comprising:

a plurality of support stands each having a circular cross-section and each having a periphery formed with six elongated flanges and six arcuate connecting faces located between the flanges;

the flanges being arranged in an annular shape to form a circular cross-sectional configuration:

each of the flanges having two opposite sides each formed with a neck connected to a respective one of the arcuate connecting faces; and each of the flanges having a surface formed with a plurality of grooves.

2. The shelf in accordance with claim 1, wherein each of the support stands has a tubular shape.

3. The shelf in accordance with claim 1, wherein the flanges are equally distant from each other to form an equally angular configuration.

4. The shelf in accordance with claim 1, wherein each of the flanges is directed toward a center of each of the support stands.

5. The shelf in accordance with claim 4, wherein each of the flanges has a tapered width gradually reduced from the periphery to the center of each of the support stands.

6. The shelf in accordance with claim 1, wherein each of the flanges has a dovetail-shaped cross-section.

7. The shelf in accordance with claim 1, wherein the grooves of the flanges are arranged in a circular shape to form a circular cross-sectional configuration.

8. The shelf in accordance with claim 1, further comprising a rack provided with a plurality of arcuate mounting plates, and a plurality of arcuate fixing plates each mounted on a respective one of the mounting plates of the rack, wherein each of the support stands is mounted on a respective one of the fixing plates for supporting the rack.

9. The shelf in accordance with claim 8, wherein each of the fixing plates has a first side mounted on a respective one of the mounting plates of the rack and a second side mounted on either one of the flanges of the respective support stands, the second side of each of the fixing plates is formed with a plurality of insertion strips each inserted into a respective one of the grooves of the respective flange.

10. The shelf in accordance with claim 8, wherein each of the fixing plates has two ends each formed with a hook urged on the neck of the respective flange.

11. The shelf in accordance with claim 1, wherein each of the six flanges of each of the support stands is protruded radially and outwardly from a center of each of the support stands for mounting a rack, so that any two of the six flanges of each of the support stands connect two racks which are arranged in an angular manner to form an angular configuration.

12. The shelf in accordance with claim 11, wherein the six flanges of each of the support stands are equally distant from each other by sixty degrees so that the six flanges of each of the support stands surround the center of each of the support stands to form an equally angular configuration.

* * * * *